US006945854B2

(12) United States Patent
Kurashima et al.

(10) Patent No.: US 6,945,854 B2
(45) Date of Patent: Sep. 20, 2005

(54) SEMICONDUCTOR DEVICE FABRICATION METHOD AND APPARATUS

(75) Inventors: Nobuyuki Kurashima, Kanagawa (JP); Gaku Minamihaba, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/960,019

(22) Filed: Oct. 8, 2004

(65) Prior Publication Data

US 2005/0113001 A1 May 26, 2005

(30) Foreign Application Priority Data

Oct. 30, 2003 (JP) ..... 2003-371079

(51) Int. Cl.[7] ..... B24B 1/00; B24B 7/00
(52) U.S. Cl. ..... 451/41; 54/285
(58) Field of Search ..... 451/41, 42, 54, 451/526, 490, 283, 285, 286, 287, 288, 289, 290

(56) References Cited

U.S. PATENT DOCUMENTS 5,367,980 A * 11/1994 Itom et al. ..... 117/86
6,054,048 A * 4/2000 Kaeriyama et al. ..... 210/220
6,667,238 B1 12/2003 Kimura et al.
2002/0016145 A1 * 2/2002 Tominaga et al. ..... 451/526
2004/0065625 A1 * 4/2004 Fukui et al. ..... 210/748
2004/0087118 A1 * 5/2004 Maegawa et al. ..... 438/514

FOREIGN PATENT DOCUMENTS

| | | |
|---|---|---|
| JP | 2000-192086 | 7/2000 |
| JP | 2000-294524 | 10/2000 |
| JP | 2001-358111 | 12/2001 |

* cited by examiner

*Primary Examiner*—Jacob K. Ackun, Jr.
(74) *Attorney, Agent, or Firm*—Finnegan, Henderson, Farabow, Garrett & Dunner, L.L.P.

(57) ABSTRACT

Provided is a semiconductor device fabrication apparatus comprising:

a filter which contains a polar crystal, and filters pure water or a liquid containing pure water as a solvent; and a working section which has a pressing mechanism configured to apply a pressure to said filter, and supplies the filtered pure water or the filtered liquid containing pure water as a solvent to a surface of an object to be polished or cleaned, thereby performing a polishing process or cleaning process.

20 Claims, 4 Drawing Sheets

SEMICONDUCTOR DEVICE FABRICATION METHOD AND APPARATUS

CROSS REFERENCE TO RELATED APPLICATION

This application is based upon and claims benefit of priority under 35 USC §119 from the Japanese Patent Application No. 2003-371079, filed on Oct. 30, 2003, the entire contents of which are incorporated herein by reference.

BACKGROUND OF THE INVENTION

The present invention relates to a semiconductor device fabrication method and apparatus.

In the field of recent semiconductor device fabrication, the development of micropatterned, high-density, multilayered interconnections is rapidly advancing as the LSI performance improves. Accordingly, the technique is rapidly improving in each fabrication process.

For example, in a CMP (Chemical Mechanical Polishing) process used in the formation of metal damascene interconnections, high cleaning is necessary in cleaning during or after polishing. This is so because even a slight amount of impurity has a large influence on the yield as micropatterning progresses.

As described above, it is important to increase the level of cleanliness in each process, and advance to the subsequent process without leaving any impurity or residue produced in the preceding process behind.

The cleaning process, however, is complicated because too much importance is attached to the performance and effect of, e.g., a slurry and liquid chemical.

Accordingly, the sizes of attached apparatuses increase, and there is no inexpensive, effective cleaning member which can be easily attached.

For example, patent reference 1 describes the overall arrangement of a CMP apparatus. This apparatus is characterized by cleaning a substrate by supplying ionic water. However, a practical arrangement of this ionic water supply apparatus is as disclosed in FIG. 2 of patent reference 2. That is, the increase in size of the apparatus is unavoidable.

Patent reference 1: Japanese Patent Laid-Open No. 2000-294524

Patent reference 2: Japanese Patent Laid-Open No. 2001-358111

As described above, no conventional apparatus can achieve high cleanliness with a compact, simple arrangement.

SUMMARY OF THE INVENTION

According to one aspect of the present invention, there is provided a semiconductor device fabrication apparatus comprising:

a filter which contains a polar crystal, and filters pure water or a liquid containing pure water as a solvent; and a working section which has a pressing mechanism configured to apply a pressure to said filter, and supplies the filtered pure water or the filtered liquid containing pure water as a solvent to a surface of an object to be polished or cleaned, thereby performing a polishing process or cleaning process.

According to another aspect of the present invention, there is provided a semiconductor device fabrication method comprising:

supplying pure water or a liquid containing pure water as a solvent to a filter containing a polar crystal while applying a pressure to the filter, thereby filtering the pure water or the liquid containing pure water as a solvent; and supplying the filtered pure water or the filtered liquid containing pure water as a solvent to a surface of an object to be polished or cleaned, thereby performing a polishing process or cleaning process.

According to still another aspect of the present invention, there is provided a semiconductor device fabrication method comprising:

placing an object to be polished or cleaned in a manner that a surface to be polished or cleaned is in contact with a pad placed on a surface of a turntable; and rotating the turntable, and supplying pure water or a liquid containing pure water as a solvent to a central region of the pad, thereby polishing or cleaning the object to be polished or cleaned, wherein the pad has a filter which contains a polar crystal, and filters the pure water or the liquid containing pure water as a solvent supplied to the central region, and the pure water or the liquid containing pure water as a solvent filtered by the filter is supplied to the surface of the object to be polished or cleaned.

DETAILED DESCRIPTION OF THE INVENTION

Embodiments of the present invention will be described below with reference to the accompanying drawings.

(1) First Embodiment

A semiconductor device fabrication apparatus and method according to the first embodiment of the present invention will be explained below.

Figure 1:
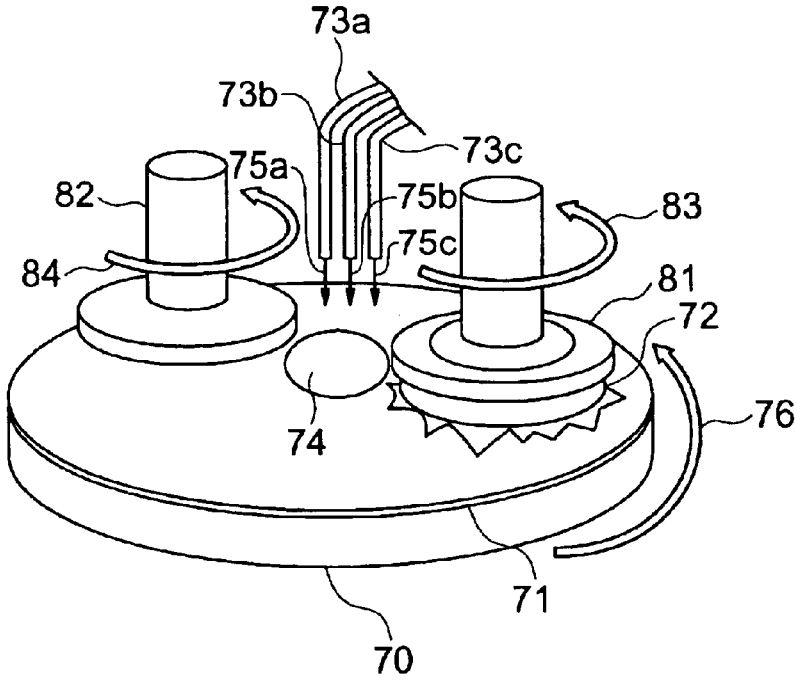
FIG. 1 is a perspective view showing the arrangement of a semiconductor fabrication apparatus according to the first embodiment of the present invention.

FIG. 1 shows the arrangement of a fabrication apparatus capable of polishing or cleaning according to the first embodiment.

A pad 71 is placed on a turntable 70 which rotates in the direction of an arrow 76.

A filter 74 is adhered on the surface of a central portion of the pad 71. It is also possible to form a hole in the central portion of the pad 71, and embed the filter 74 in this hole.

The pad 71 can be formed of a porous material having open cells. More specifically, the pad 71 can be formed of, e.g., a polymer-based material such as polyurethane or polypropylene.

The filter 74 is a sponge-like filter coated with a paste obtained by mixing a solvent, binder, or the like in grains (to be referred to as tourmaline grains hereinafter) of tourmaline as an example of a polar crystal.

A semiconductor wafer 72, for example, is placed on a region of the pad 71 except for the filter 74.

A top ring head 81 as a holding member for holding the semiconductor wafer 72 such that the semiconductor wafer 72 is in contact opposite to the pad 71 holds the semiconductor wafer 72. The top ring head 81 presses the semiconductor wafer 72 against the pad 71, and rotates in the same direction as the turntable 70 as indicated by an arrow 83. Also, a dressing head 82 for dressing the pad 71 is placed in a position where the dressing head 82 opposes the top ring head 81 on the other side of the filter 74 of the pad 71. The dressing head 82 rotates in the same direction as the top ring head 83 as indicated by an arrow 84.

On the surface of the filter 74, pure water or a liquid containing pure water as a solvent, e.g., a slurry or cleaning solution, is supplied.

Referring to FIG. 1, three liquid supply pipes 73*a* to 73*c* are arranged and, as indicated by arrows 75*a* to 75*c*, supply the desired one of the pure water, slurry, and cleaning solution. However, it is also possible to freely set the number of liquid supply pipes if necessary.

When the pure water or the liquid containing pure water as a solvent passes through the filter 74, the contained water comes in contact with the tourmaline grains to cause electrolysis, and this decomposes the water into hydrogen ions and hydroxide ions.

The hydrogen ions combine with electrons attracted to the tourmaline grains, and are released as hydrogen gas. This makes the water weakly alkaline.

The hydroxide ions react with undecomposed water to produce hydroxyl ions. This induces the surface active effect, and increases the cleaning effect.

A case in which the first embodiment is applied when CMP is performed on, e.g., an AlCu (0.5 at %) film and then a cleaning process is performed will be described below.

Figure 2A:
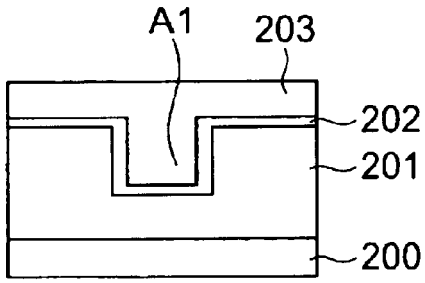
FIGS. 2A and 2B are sectional views showing the longitudinal cross sections of a semiconductor substrate when a cleaning process is performed on a TiN film and AlCu film after CMP by using the semiconductor fabrication apparatus according to the first embodiment.

As shown in FIG. 2A, a 300-nm thick insulating film 201 is deposited on a semiconductor substrate 200 by PCVD (Plasma Chemical Vapor Deposition) using a TEOS gas, and so patterned as to have a 150-nm deep trench pattern A1 as a recess.

In addition, a 10-nm thick TiN film 202 is deposited on the entire surface, and a 180-nm thick AlCu (0.5 at %) film 203 is also deposited on the entire surface.

Figure 2B:
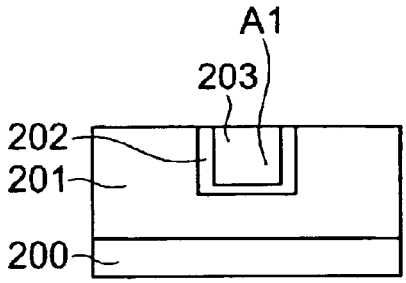

After that, as shown in FIG. 2B, unnecessary portions of the TiN film 202 and AlCu film 203 are removed by CMP, and a cleaning process is successively performed.

The first embodiment was applied to the CMP process and the cleaning process after that.

The polishing conditions and the processing conditions of cleaning were as follows.

(Polishing Conditions)

Polishing load: 300 gf/cm$^2$, carrier (top ring head) rotational speed: 102 rpm, turntable rotational speed: 100 rpm, slurry flow rate: 200 cc/min, Slurry: colloidal silica dispersion (grain size=25 nm, dispersion concentration=3 wt %, pH=7)

Polishing time: 80 sec.

(Processing Conditions)

Polishing load: 300 gf/cm$^2$, carrier (top ring head) rotational speed: 102 rpm, turntable rotational speed: 100 rpm, pure water flow rate: 500 cc/min, Processing time: 30 sec.

In Example 1 of the first embodiment, pure water for cleaning was filtered by the filter 74. In Example 2 of the first embodiment, both a slurry and pure water for cleaning were filtered by the filter 74. In Comparative Example 1 using the conventional technique, CMP was performed without filtering a slurry and pure water by the filter 74. After the processing, the numbers of particles and the numbers of defects (including the numbers of corrosions and the numbers of scratches) on the Al interconnections of these examples and comparative example were compared.

In Comparative Example 1, the number of particles was 760/cm$^2$, and the number of defects was 57/cm$^2$. In Example 1, the number of particles was 18/cm$^2$, and the number of defects was 7/cm$^2$. In Example 2, the number of particles was 15/cm$^2$, and the number of defects was 5/cm$^2$. These results reveal that the first embodiment greatly reduces the number of particles and the number of defects.

The polar crystal used in the filter 74 was black tourmaline having an average grain size of 0.5 $\mu$m and a dispersion concentration of 50 wt %. This black tourmaline was dispersed in a resin having filtering properties.

To increase the cleaning effect, the average grain size and dispersion concentration of the polar crystal are important factors.

For example, assuming that a product in which the number of scratches and the number of defects on the surface of the Al film were 20/cm$^2$ or less and 10/cm$^2$ or less, respectively, was a good product, the average grain size of the polar crystal and a non-defective product (O) and defective product (x) had the following relationship.

| | Number of scratches | Number of defects |
|---|---|---|
| No polar crystal | x | x |
| 0.05 $\mu$m | ○ | ○ |
| 0.1 $\mu$m | ○ | ○ |
| 0.5 $\mu$m | ○ | ○ |
| 1.0 $\mu$m | ○ | ○ |
| 5.0 $\mu$m | ○ | ○ |
| 10 $\mu$m | ○ | ○ |
| 50 $\mu$m | ○ | x |
| 100 $\mu$m | x | x |

Note that the dispersion concentration was 50 wt %.

The above results indicate that the average grain size of the polar crystal by which good products are obtained is 50 $\mu$m or less, preferably, 0.05 to 10 $\mu$m.

Note that no regions of less than 0.05 $\mu$m were observed because pulverization of grains of the polar crystal is generally difficult. However, since a smaller average grain size is presumably more desirable, the effect of the first embodiment can be expected.

On the other hand, when the average grain size of the polar crystal was 0.5 $\mu$m, the dispersion concentration of the grains of the polar crystal and a good product and bad product had the following relationship.

| | Number of scratches | Number of defects |
|---|---|---|
| No polar crystal | x | x |
| 1 wt % | ○ | x |
| 5 wt % | ○ | ○ |
| 10 wt % | ○ | ○ |
| 25 wt % | ○ | ○ |
| 50 wt % | ○ | ○ |
| 75 wt % | ○ | ○ |
| 90 wt % | ○ | ○ |
| 99 wt % | ○ | ○ |

From the above results, the dispersion concentration of the polar crystal by which good products are obtained is 1 wt % or more, preferably, 5 to 99 wt %.

(2) Second Embodiment

The second embodiment of the present invention will be described below with reference to the accompanying drawings.

Figure 3:
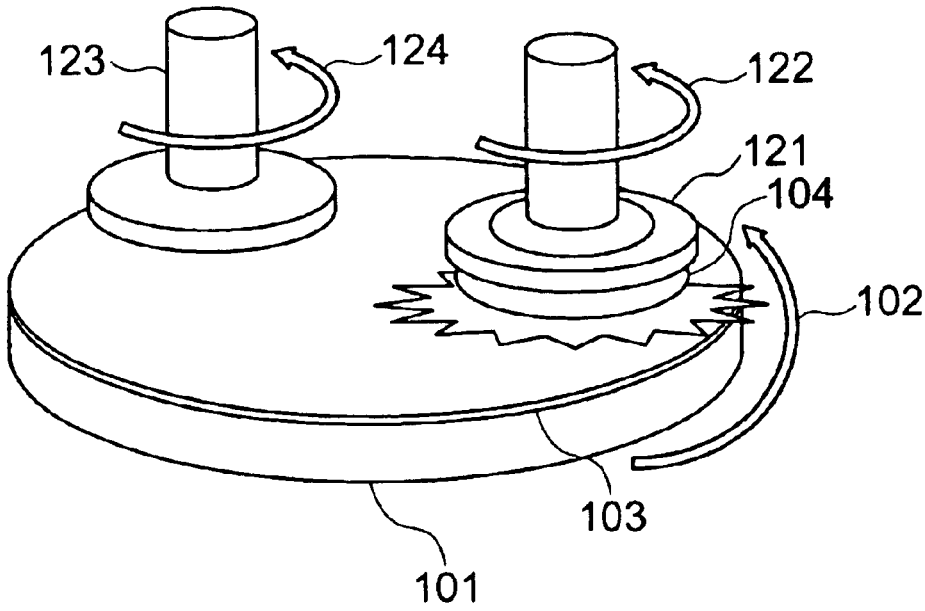
FIG. 3 is a perspective view showing the arrangement of a semiconductor fabrication apparatus according to the second embodiment of the present invention.

FIG. 3 shows an outline of the overall arrangement of a polishing apparatus.

Polishing cloth (a pad) 103 is placed on a turntable 101 which rotates in the direction of an arrow 102, and a semiconductor wafer, for example, is set as an object 104 to be polished.

As will be described later, a slurry is supplied inside the turntable 101 and discharged to its surface, and the discharged slurry is supplied to the surface to be polished of the object 104 through the polishing cloth 103.

A top ring head 121 as a holding member or as a pressing mechanism which presses the polishing cloth 103 holds the object 104, and rotates the object 104 while pressing it against the polishing cloth 103. Also, a dressing head 123 for dressing the polishing cloth 103 opposes the top ring head 121 on the other side of the center of the turntable 101, and rotates in the same direction as the top ring head 121 as indicated by an arrow 124.

Figure 4:
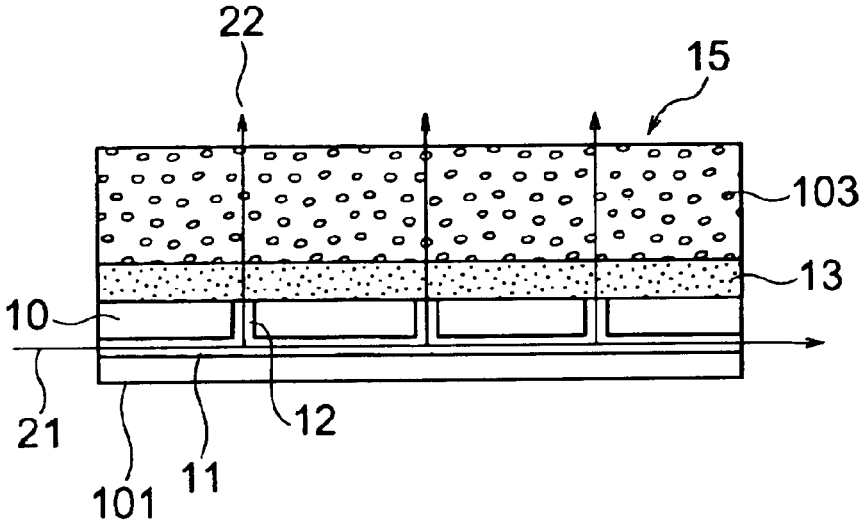
FIG. 4 is a longitudinal cross sectional view showing the arrangements of polishing cloth and a turntable used in the semiconductor fabrication apparatus shown in FIG. 3.

FIG. 4 shows the sectional structures of the polishing cloth 103 and turntable 101.

The turntable 101 has a piping mechanism 10 having a pipe 11 in which a slurry flows in the direction of an arrow 21, and pipes 12 in which a slurry flows in the direction of arrows 22.

The polishing cloth 103 is adhered on the surface of the turntable 101 by, e.g., a double-coated adhesive tape (not shown). A filter 13 containing tourmaline grains is formed on that surface of the polishing cloth 103, which is in contact with the turntable 101.

A slurry supplied through the pipes 11 and 12 is filtered through the filter 13, penetrates into the polishing cloth 103, and oozes out onto a surface 15 of the polishing cloth 103. As described above, the object 104 to be polished is pressed against the surface 15, and rotated in contact with the surface 15.

The polishing cloth 103 can be formed of, e.g., a porous material having open cells. For example, the polishing cloth 103 can be formed of a polymer-based material such as polyurethane or polypropylene.

The filter is a sponge-like filter which is formed by using a material such as polyurethane and coated with a paste obtained by mixing a solvent, binder, or the like in tourmaline grains.

When a slurry passes through the filter 13 as described above, water contained in the slurry comes in contact with the tourmaline grains to cause electrolysis. Hydrogen ions produced by decomposition combine with electrons attracted to the tourmaline grains, and are released as hydrogen gas. This makes the water weakly alkaline. Also, hydroxide ions react with undecomposed water to produce hydroxyl ions. This increases the cleaning effect.

The arrangement of a substrate to be polished and the polishing conditions were the same as in the first embodiment.

On the same polishing table, cleaning was performed under the following processing conditions.

(Processing Conditions)

Polishing load: 300 gf/cm$^2$, carrier (top ring head) rotational speed: 102 rpm, turntable rotational speed: 100 rpm, pure water flow rate: 500 cc/min, Processing time: 30 sec.

After the polishing, the numbers of particles and the numbers of defects on the Al interconnections were compared. Consequently, while the number of particles was 18/cm$^2$ and the number of defects was 7/cm$^2$ in Example 1 of the first embodiment, the number of particles was 10/cm$^2$ and the number of defects was 4/cm$^2$ in Example 3 of the second embodiment. This indicates that the second embodiment can further reduce the number of particles and the number of defects from those of the first embodiment.

As described above, the second embodiment uses the piezoelectric effect of the polar crystal by which the polar crystal generates a voltage when a pressure is applied to it, thereby electrically promoting activation and further increasing the cleaning effect.

(3) Third Embodiment

A cleaning apparatus and method will be described below as a semiconductor fabrication apparatus and method, respectively, according to the third embodiment of the present invention.

The third embodiment uses a pressure as in the second embodiment, but uses no polishing table.

Figure 5:
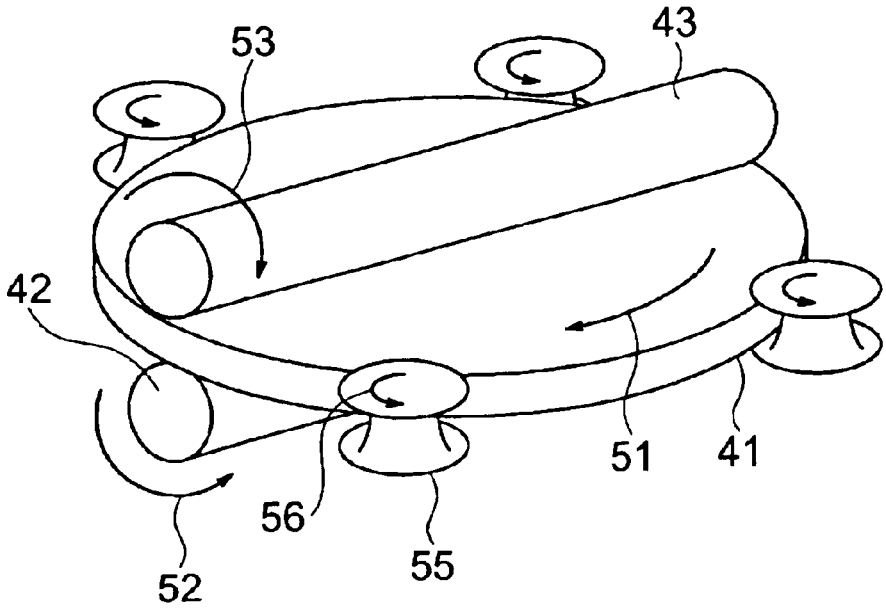
FIG. 5 is a perspective view showing the arrangement of a semiconductor fabrication apparatus according to the third and fourth embodiments of the present invention.

As shown in FIG. 5, a semiconductor wafer 41 is supported by a plurality of rollers 55. When the rollers 55 rotate in the direction of an arrow 56, the semiconductor wafer 41 rotates in the direction of an arrow 51. Rolls 42 and 43 are arranged on the two surfaces of the semiconductor wafer 41, and rotate in opposite directions indicated by arrows 52 and 53, respectively.

Figure 6:
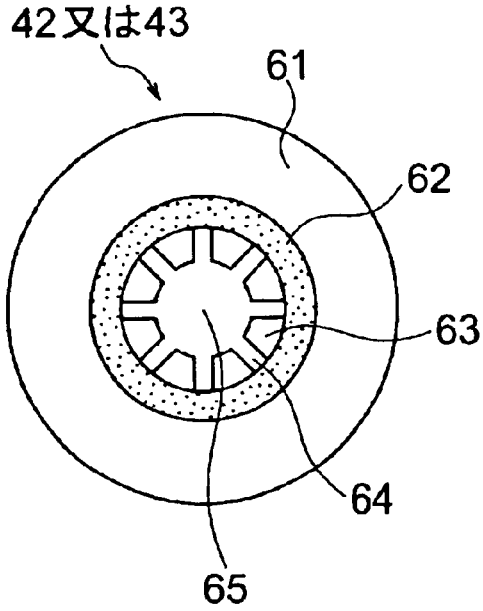
FIG. 6 is a longitudinal cross sectional view showing the arrangement of a roll used in the semiconductor fabrication apparatus shown in FIG. 5.

As will be described later, each of the rolls 42 and 43 contains a filter, and also functions as a pressing mechanism which applies a pressure to this filter. FIG. 6 shows the sectional structure of each of the rolls 42 and 43.

A sponge-like, ring-shaped elastic member 61 is formed on the outer circumferential surface of the roll 42 (43). The elastic member 61 presses the surface of the semiconductor wafer 41 in direct contact with it. A ring-like filter 62 is formed on the inner surface of the elastic member 61.

Similar to the filter 13 of the second embodiment, the filter 62 is a sponge-like filter which is made of, e.g., polyurethane and coated with a paste obtained by mixing a solvent, binder, or the like in tourmaline grains.

A piping mechanism 63 is placed inside the roll 42 (43). Accordingly, a hollow portion 65 is present in a central portion of the roll 42 (43), and passages 64 are radially formed from the hollow portion 65.

Pure water or cleaning water is supplied into the hollow portion 65, and passes through the filter 62 through the passages 64. This pure water or cleaning water passing through the filter 62 diffuses and is held inside the sponge-like elastic member 61. When the elastic member 61 is rotated as it is pressed against the semiconductor wafer 41, the pure water or cleaning water is supplied onto the surface of the semiconductor wafer 41 and cleans it.

Practical examples of the third embodiment will be explained below.

Figure 7A:
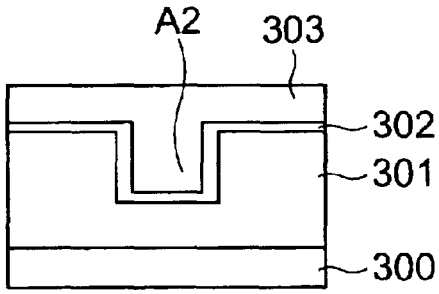
FIGS. 7A and 7B are sectional views showing the longitudinal cross sections of a semiconductor substrate when a cleaning process is performed on a Ta film and Cu film after CMP by using the semiconductor fabrication apparatuses according to the third and fourth embodiments.

As shown in FIG. 7A, a 300-nm thick insulating film 301 made of black diamond (manufactured by AMAT) is deposited by PCVD on a semiconductor substrate 300 as a substrate to be polished, and so patterned as to have a 150-nm deep trench pattern A2.

After that, a 6-nm thick Ta film 302 is deposited on the entire surface, and a 180-nm thick Cu film 303 is also deposited on the entire surface.

Figure 7B:
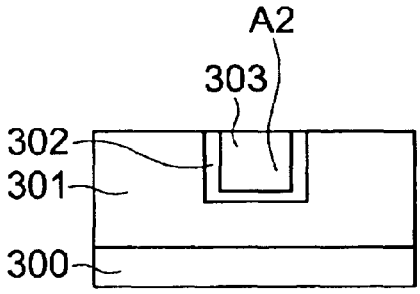

As shown in FIG. 7B, unnecessary portions of the Ta film 302 and Cu film 303 are removed by CMP.

The substrate 300 is then moved from the polishing table to an apparatus for performing roll cleaning, and a cleaning process is performed. The third embodiment is applied to this cleaning process after CMP.

The practical polishing conditions are as follows.

(Polishing Conditions)

Polishing load: 300 gf/cm$^2$, carrier (top ring head) rotational speed: 102 rpm, turntable rotational speed: 100 rpm, slurry flow rate: 200 cc/min, Slurry: CMS7401+CMS7452 (manufactured by JSR)

Polishing cloth: IC1000 (manufactured by Rodel)

Polishing time: 60 sec.

The practical processing conditions of cleaning are as follows.

(Processing Conditions)

Polishing load: 300 gf/cm$^2$, roll rotational speed: 150 rpm, semiconductor substrate rotational speed: 30 rpm, pure water flow rate: 1,000 cc/min, Processing time: 30 sec.

Note that five types of tourmaline grains presented below were dispersed in the filter 62.

EXAMPLE 4

Black tourmaline (average grains size: 0.5 $\mu$m, dispersion concentration: 50 wt %)

EXAMPLE 5

Black tourmaline (average grains size: 0.5 $\mu$m, dispersion concentration: 35 wt %)+red tourmaline (average grains size: 0.5 $\mu$m, dispersion concentration: 15 wt %)

EXAMPLE 6

Black tourmaline (average grains size: 0.5 $\mu$m, dispersion concentration: 25 wt %)+red tourmaline (average grains size: 0.5 $\mu$m, dispersion concentration: 25 wt %)

EXAMPLE 7

Black tourmaline (average grains size: 0.5 $\mu$m, dispersion concentration: 15 wt %)+red tourmaline (average grains size: 0.5 $\mu$m, dispersion concentration: 35 wt %)

EXAMPLE 8

Red tourmaline (average grains size: 0.5 $\mu$m, dispersion concentration: 50 wt %)

In Examples 4 to 8 according to the third embodiment, pure water was filtered by the filter 62. In Comparative Example 2 according to the conventional technique, pure water was not filtered by the filter 62. In each of these examples and comparative example, the yield on an interconnection having a width of 0.1 $\mu$m and a length of 1 m was checked.

In Comparative Example 2, the yield was 85% . By contrast, in each of Examples 4 to 8, the yield was 97% or more, i.e., the yield increased by 12% or more.

Also, the same effect could be obtained even when a mixture of tourmaline grains was used. Furthermore, the same effect was obtained even when the substrate to be polished or the substrate to be cleaned was hydrophobic.

(4) Fourth Embodiment

The fourth embodiment of the present invention will be described below.

The fourth embodiment differs from the third embodiment using pure water in that a liquid chemical containing pure water as a solvent is used. The rest of the arrangement is the same as the third embodiment, so a detailed explanation thereof will be omitted.

The practical processing conditions of cleaning are as follows.

In Example 9 of the fourth embodiment, unlike in Examples 4 to 8 of the third embodiment, the processing conditions of cleaning after polishing included the use of a solution mixture of pure water and an aqueous citric acid solution.

(Processing Conditions)

Load: 300 gf/cm$^2$, roll rotational speed: 150 rpm, semiconductor substrate rotational speed: 30 rpm, pure water flow rate: 500 cc/min, 0.6 wt % aqueous citric acid solution flow rate: 500 cc/min., Processing time: 30 sec.

The yield of interconnections in Example 9 of the fourth embodiment increased to 99% or more from 97% or more of Examples 4 to 8 of the third embodiment.

In the first to fourth embodiments as described above, pure water or a liquid containing pure water as a solvent is filtered by a filter containing a polar crystal, and supplied to the surface of an object to be polished or cleaned. Since this makes a large-scale apparatus such as an ionic water supply apparatus unnecessary, it is possible to decrease the size of the apparatus, reduce the cost, and improve the cleanliness.

Each of the above embodiments is merely an example, and hence does not limit the present invention. Therefore, these embodiments can be variously modified within the technical scope of the present invention.

In each embodiment, tourmaline is used as a polar crystal. More specifically, it is possible to use at least one type of black tourmaline, red tourmaline, schorl tourmaline, lithium tourmaline, dravite tourmaline, rubelite tourmaline, pink tourmaline, indicolite, paraiba tourmaline, and watermelon, or a mixture of these tourmalines. Regardless of the type of tourmaline used in each embodiment, the average grain size and dispersion concentration of the polar crystal are preferably 50 $\mu$m or less and 1 wt % or more, respectively, and more preferably, 0.05 to 10 $\mu$m and 5 to 99 wt %, respectively.

Also, as pure water or a liquid containing pure water as a solvent, it is possible to appropriately use a slurry or cleaning water such as a liquid chemical.

What is claimed is:

1. A semiconductor device fabrication apparatus comprising:

a filter which contains a polar crystal, and filters pure water or a liquid containing pure water as a solvent; and a working section which has a pressing mechanism configured to apply a pressure to said filter, and supplies the filtered pure water or the filtered liquid containing pure water as a solvent to a surface of an object to be polished or cleaned, thereby performing a polishing process or cleaning process.

2. An apparatus according to claim 1, wherein the polar crystal is at least one type of material or a mixture of materials selected from the group consisting of black tourmaline, red tourmaline, schorl tourmaline, lithium tourmaline, dravite tourmaline, rubelite tourmaline, pink tourmaline, indicolite, paraiba tourmaline, and watermelon.

3. An apparatus according to claim 1, wherein the polar crystal is granular, and has an average grain size of not more than 50 $\mu$m.

4. An apparatus according to claim 1, wherein the polar crystal is granular, and has a dispersion concentration of not less than 1 wt % in a resin contained in said filter.

5. An apparatus according to claim 1, wherein said working section has:

a rotatable turntable having a piping mechanism which receives a slurry and discharges the slurry to a surface of said turntable; and a holding member which functions as said pressing mechanism in said working section, and holds the object to be polished in contact opposite to a surface of polishing cloth which is placed on the surface of said turntable, has said filter, filters the slurry discharged from the surface of said turntable, and supplies the slurry to the surface of the object to be polished.

6. An apparatus according to claim 5, wherein the polar crystal is at least one type of material or a mixture of materials selected from the group consisting of black tourmaline, red tourmaline, schorl tourmaline, lithium tourmaline, dravite tourmaline, rubelite tourmaline, pink tourmaline, indicolite, paraiba tourmaline, and watermelon.

7. An apparatus according to claim 5, wherein the polar crystal is granular, and has an average grain size of not more than 50 $\mu$m.

8. An apparatus according to claim 1, wherein said working section has:

a support mechanism which supports the object to be cleaned; and first and second cylindrical rolls which are arranged on two surfaces of the object to be cleaned, and rotate in opposite directions, wherein each of said first and second rolls comprises:

a piping mechanism which is placed in a central portion, receives pure water or cleaning water, and radially discharges the pure water or cleaning water, said filter surrounding an outer circumferential surface of said piping mechanism and filtering the discharged pure water or cleaning water; and an elastic member which surrounds an outer circumferential surface of said filter, and supplies the filtered pure water or cleaning water to the surface of the object to be cleaned.

9. An apparatus according to claim 8, wherein the polar crystal is at least one type of material or a mixture of materials selected from the group consisting of black tourmaline, red tourmaline, schorl tourmaline, lithium tourmaline, dravite tourmaline, rubelite tourmaline, pink tourmaline, indicolite, paraiba tourmaline, and watermelon.

10. An apparatus according to claim 8, wherein the polar crystal is granular, and has an average grain size of not more than 50 $\mu$m.

11. A semiconductor device fabrication method comprising:

supplying pure water or a liquid containing pure water as a solvent to a filter containing a polar crystal while applying a pressure to the filter, thereby filtering the pure water or the liquid containing pure water as a solvent; and supplying the filtered pure water or the filtered liquid containing pure water as a solvent to a surface of an object to be polished or cleaned, thereby performing a polishing process or cleaning process.

12. A method according to claim 11, wherein the polar crystal is at least one type of material or a mixture of materials selected from the group consisting of black tourmaline, red tourmaline, schorl tourmaline, lithium tourmaline, dravite tourmaline, rubelite tourmaline, pink tourmaline, indicolite, paraiba tourmaline, and watermelon.

13. A method according to claim 11, wherein the polar crystal is granular, and has an average grain size of not more than 50 $\mu$m.

14. A method according to claim 11, wherein the polar crystal is granular, and has a dispersion concentration of not less than 1 wt % in a resin contained in said filter.

15. A method according to claim 11, further comprising obtaining the object to be polished by depositing a conductive material on an insulating film formed above a semiconductor substrate so as to fill a recess formed in the insulating film, wherein the polishing process is performed by supplying, to the surface of the object to be polished, the pure water or the liquid containing pure water as a solvent filtered by a polishing pad having the filter, thereby removing the conductive material deposited on the insulating film except for the recess.

16. A method according to claim 15, wherein the polishing process is performed by supplying, to the surface of the object to be polished, a slurry filtered by the polishing pad having the filter.

17. A semiconductor device fabrication method comprising:

placing an object to be polished or cleaned in a manner that a surface to be polished or cleaned is in contact with a pad placed on a surface of a turntable; and rotating the turntable, and supplying pure water or a liquid containing pure water as a solvent to a central region of the pad, thereby polishing or cleaning the object to be polished or cleaned, wherein the pad has a filter which contains a polar crystal, and filters the pure water or the liquid containing pure water as a solvent supplied to the central region, and the pure water or the liquid containing pure water as a solvent filtered by the filter is supplied to the surface of the object to be polished or cleaned.

18. A method according to claim 17, wherein the polar crystal is at least one type of material or a mixture of materials selected from the group consisting of black tourmaline, red tourmaline, schorl tourmaline, lithium tourmaline, dravite tourmaline, rubelite tourmaline, pink tourmaline, indicolite, paraiba tourmaline, and watermelon.

19. A method according to claim 17, wherein the polar crystal is granular, and has an average grain size of not more than 50 $\mu$m.

20. A method according to claim 17, wherein the polar crystal is granular, and has a dispersion concentration of not less than 1 wt % in a resin contained in said filter.

* * * * *